US006474994B2

(12) United States Patent
Yeh

(10) Patent No.: US 6,474,994 B2
(45) Date of Patent: Nov. 5, 2002

(54) SMA (SUB-MINIATURE) CONNECTOR STRUCTURE

(76) Inventor: Chih-Chuan Yeh, PO Box 82-144, Taipei (TW)

( * ) Notice: Subject to any disclaimer, the term of this patent is extended or adjusted under 35 U.S.C. 154(b) by 0 days.

(21) Appl. No.: 09/755,067

(22) Filed: Jan. 8, 2001

(65) Prior Publication Data

US 2002/0090840 A1 Jul. 11, 2002

(51) Int. Cl.[7] ..... H01R 9/05
(52) U.S. Cl. ..... 439/63; 439/578
(58) Field of Search ..... 439/578–585, 439/63

(56) References Cited

U.S. PATENT DOCUMENTS 5,928,032 A * 7/1999 Dreesen ..... 439/578
6,152,743 A * 11/2000 Fox ..... 439/63

* cited by examiner

*Primary Examiner*—Gary F. Paumen
(74) *Attorney, Agent, or Firm*—Leong C. Lei

(57) ABSTRACT

An improved SMA (SUB-MINIATURE) connector structure, particularly one that utilizes an insert ring member inserted into a receiving hole in a T-shaped connector to quickly insert and retain an insulation member in the T-shaped connector to thereby achieve, a connector that has advantages of quick assembly and reduced costs.

1 Claim, 5 Drawing Sheets

SMA (SUB-MINIATURE) CONNECTOR STRUCTURE

BACKGROUND OF THE INVENTION (a) Field of the Invention

The present invention relates to an improvement in the SMA (SUB-MINIATURE) connector structure.

(b) Description of the Prior Art

With the advance of technology, there are demands for compact and quality products. Quick assembly and low costs are objects of developing new products, for example, manufacturers of coaxial cable connectors focus on developing connectors that are quick to assembly and inexpensive to manufacture. With reference to FIG. 1, the; middle portion of a T-shaped connector 11 is provided with a receiving hole 111'. An exit 113' at the bottom portion of the receiving hole 111' has a diameter smaller than an entrance 112' thereof. The receiving hole 111' is sized to receive an insulation member 14' having a wire hole 141' in the middle portion thereof. a lateral annular edge of the insulation member 14' abuts against an annular edge wall of the exit 113' . Upper and lower opposed injection holes 15' are formed in the T-shaped connector 11' at positions corresponding to the lateral edge of the insulation member 14' in the receiving hole 111'. A plastic substance 118' is injected via the injection hole 15' to adhere the insulation member 14' firmly in the receiving hole 111'. With reference to FIG. 2, the middle portion of a T-shaped connector 11' is provided with a receiving hole 111'. The rear end of the inner edge of the interior of the receiving hole 111' is provided with an insert ring wall 116' that has a diameter smaller than that of the receiving hole 111' and that projects inwardly The rear end of the insert ring wall 116' is pre-formed with an insert hole 117'. An insulation member 14' having a wire hole 141' in the middle portion thereof is disposed in the receiving hole 111'. An insert ring member 12 is retained on an outer edge face projecting from he insulation member 14', and is inserted into the insert hole 117' in the rear end of ' the receiving hole' 111' to thereby retain the insulation member 14' in the receiving hole 111'. There are drawbacks with these two types of assembly. First, forming two injection holes in the T-shaped connector and injecting a plastic substance to secure the insulation member is not only laborious and time-consuming, the assembly efficiency is low. As for the other method of assembly, it is also time-consuming and laborious to drill an insert hole in the receiving hole in one side of the T-shaped connector. Besides, since it requires secondary processing, it is not economical. Furthermore, whether hole drilling or rear insertion is adopted, the connector is not pleasing in appearance.

SUMMARY OF THE INVENTION

The present invention relates to an improvement in the SMA (SUB-MINIATURE) connector structure.

It is the primary object of the present invention to provide an improved SMA (SUB-MINIATURE) connector structure, particularly one that utilizes an insert ring member inserted into a receiving hole in a T-shaped connector to quickly insert and retain an insulation member in the T-shaped connector to thereby achieve a connector that has advantages of quick assembly and reduced costs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
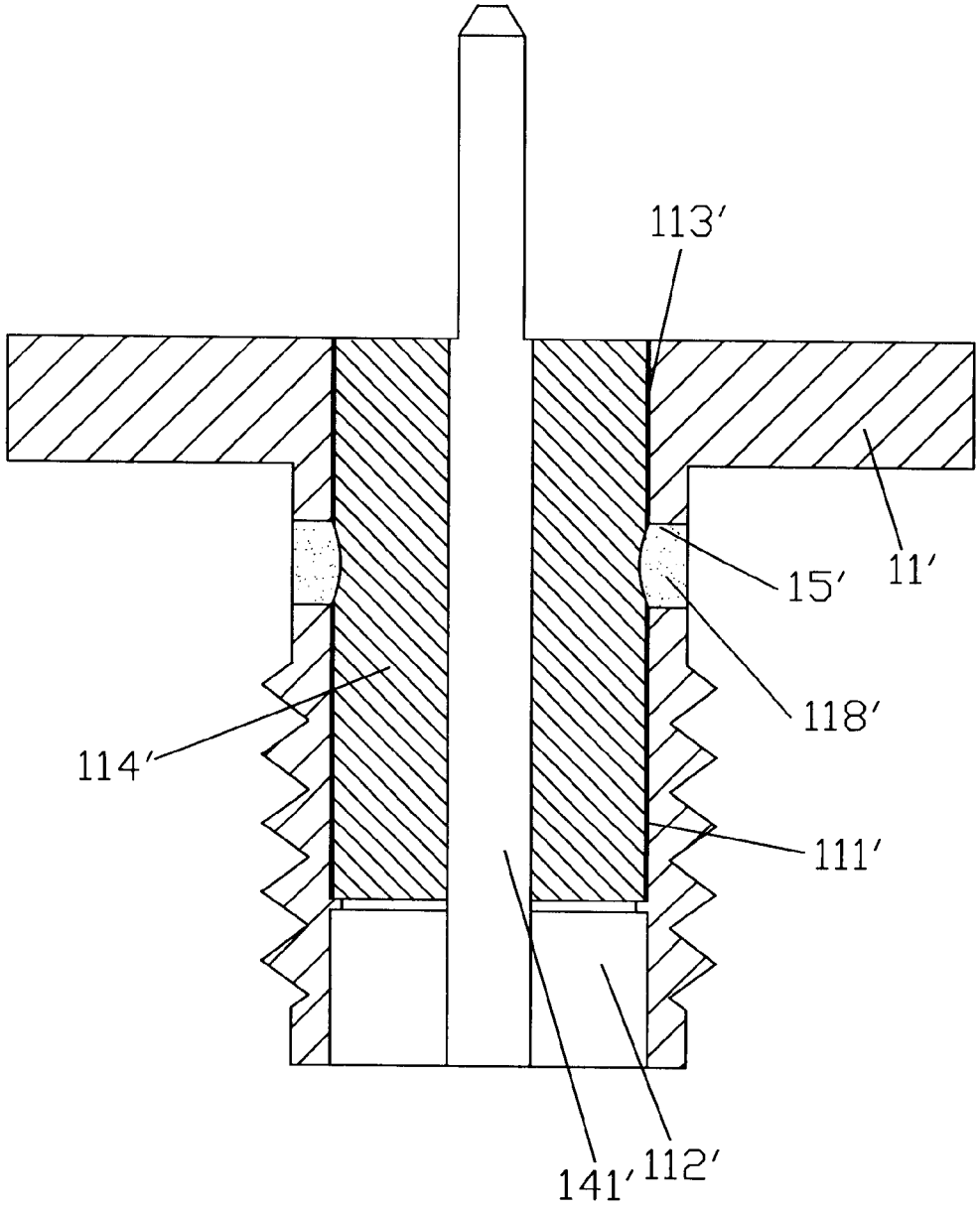
PRIOR ART FIG. 1
FIG. 1 is a sectional view of a conventional product.
Figure 2:
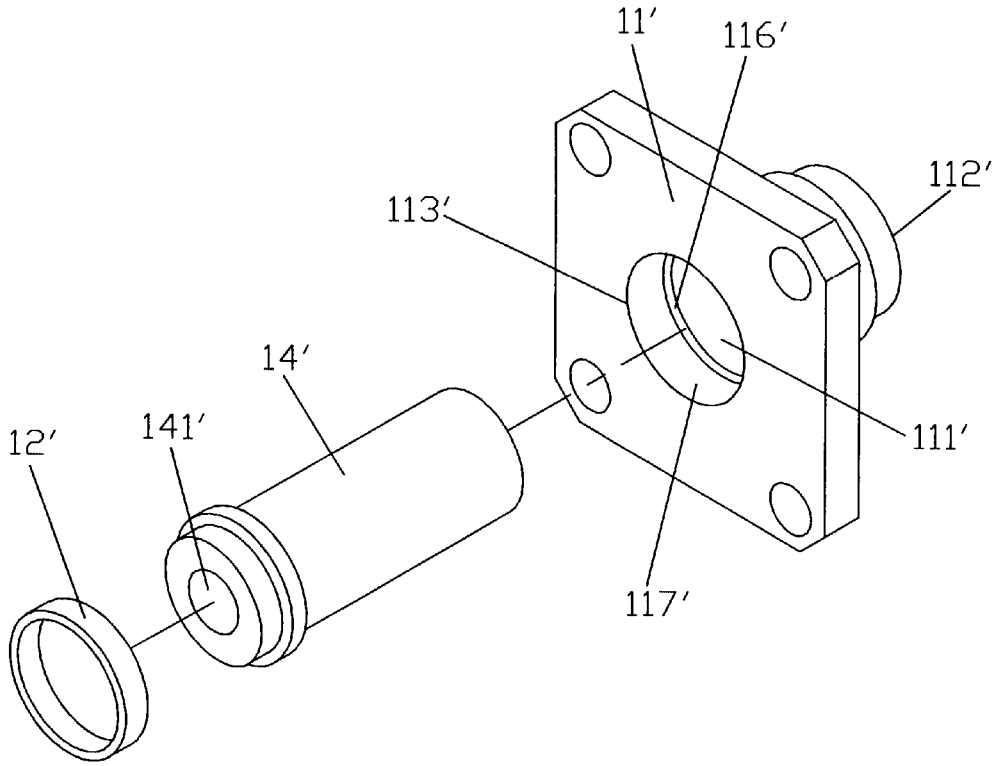
PRIOR ART FIG.2
FIG. 2 is an exploded perspective view of another conventional product.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
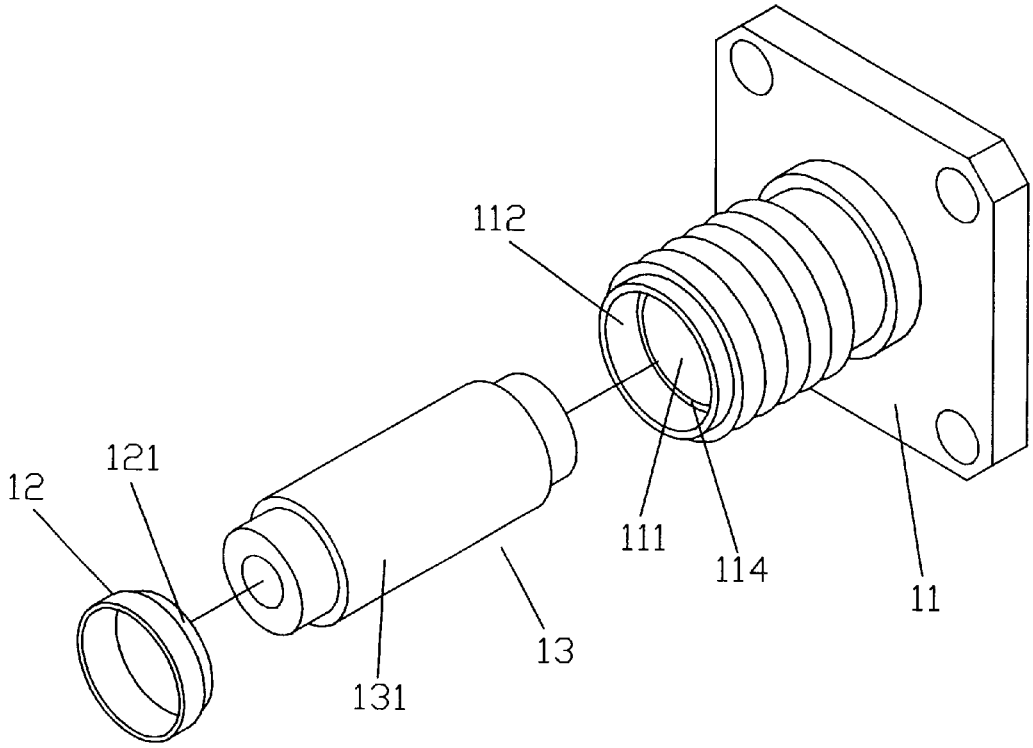
FIG. 3 is an exploded perspective view of the present invention.
Figure 4:
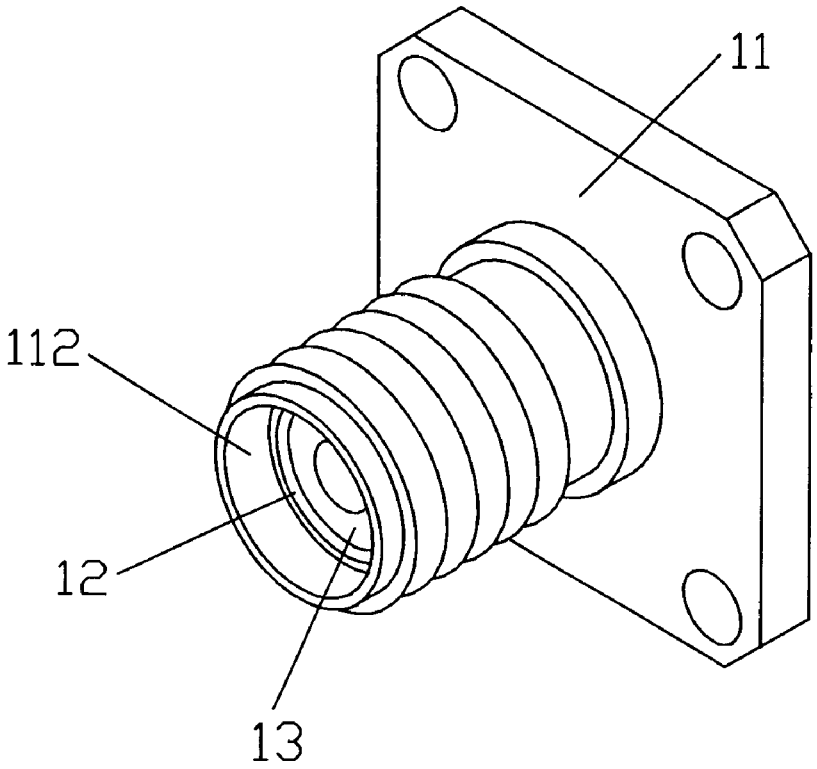
FIG. 4 is an assembled perspective view of the present invention.
Figure 5:
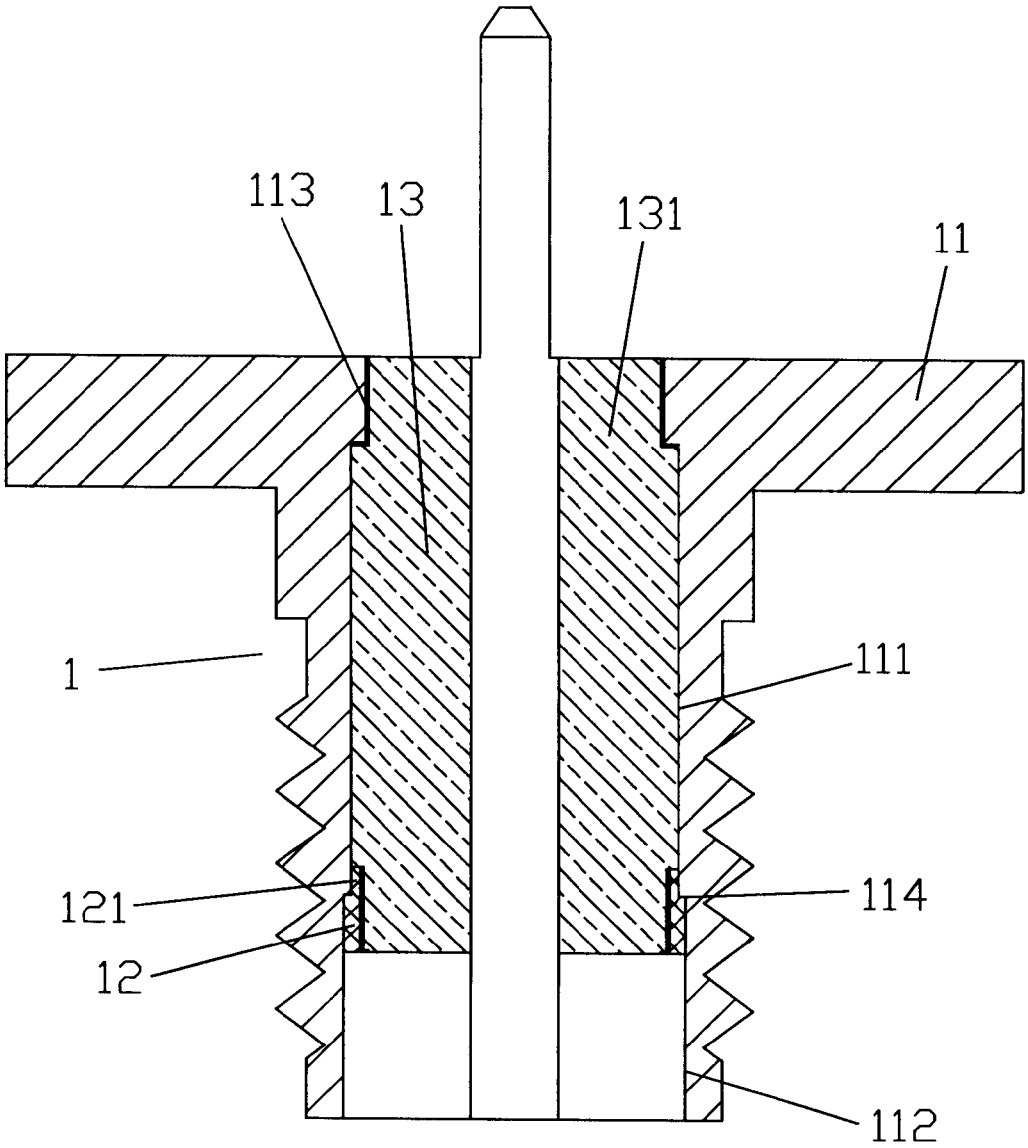
FIG. 5 is an assembled sectional view of the present invention.

With reference to FIGS. 3 to 5, the present invention includes a T-shaped connector 11, an insert ring member 12, and an insulation member 13. The T-shaped connector 11 is generally T-shaped and includes a through receiving hole 111 in a middle portion thereof. An entrance 112 having a diameter slightly greater than that of the receiving hole 111 and an insert ring wall 114 are provided at the entrance 112 of the inner edge of the interior of the receiving hole 111 at suitable positions. The other end of the receiving hole 111 is provided with an exit 113 of a diameter slightly smaller than that of the receiving hole 111. The size of the receiving hole 111 may just receive the insulation member 13 disposed therein, and the size of the insulation member 13 is such that it can be insertably retained in the exit 113 at one end of the receiving hole 111 so that a lateral edge of an enlarged portion 131 at one end of the insulation member 13 may just abut against a wall edge of the receiving hole 111.

The insert ring member 12 is substantially hollow and tapered. The insert ring member 12 is sized to be insertable into the entrance 112 at one end of the receiving hole 111. A middle portion of the insert ring member 12 is provided with an insert wall 121 at a suitable, position such that the smaller diameter portion of the insert ring member 12 is insertedly disposed on an annular ring at one end of the insulation member 13 surrounded by the interior of the entrance 112 of the receiving hole 111, and the insert wall 121 of the insert ring member 12 abuts against the insert ring wall 114 at the inner edge of the entrance 112 of the receiving hole 111.

The insulation member 13 is a cylindrical member with two smaller ends and is sized to be insertable into the receiving hole 111 in the T-shaped connector 11, with the other end of the insulation member 13 sized to be insertably retained in the exit 113 at one end of the receiving hole 111, and lateral edge of the enlarged portion 131 of the insulation member 13 abutting against the wall edge of the exit 113 of the interior of the receiving hole 111. The other end of the insulation member 13 is disposed to retain and surround the smaller-diameter portion of the insert ring member 12 that is inserted into the receiving hole 11 so that the insulation member 13 is insertedly retained in the receiving hole 111 of the T-shaped connector 11.

With reference to FIGS. 3 and 4, when a connector 1 is to be assembled, the insulation member 13 is inserted into the receiving hole 111 in the middle portion of the T-shaped connector 11 such that one end of the insulation member 13 is retained in the exit 113 of the receiving hole 111. The insert ring member 12 is inserted into the inner edge of the entrance 112 of the receiving hole 111 such that the smaller-diameter portion of the insert ring member 12 is retained and surrounded by the annular edge of the insulation member 13 at the entrance 112, with the insert wall 121 at the middle portion of the insert ring member 12 abutting against the insert ring wall 114 at the entrance 112 at the inner edge of the interior of the receiving hole 111 to thereby retain the insulation member 13 in the receiving hole 111 of the T-shaped connector 11. By means of the above-described structural elements, the connector 1 has the advantages of quick assembly and reduced costs.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A SMA (SUB-MINIATURE) connector coaxial electrical structure comprising a T-shaped connector, an insert ring member, and an insulation member, wherein a middle portion of the T-shaped connector is provided with a through receiving hole, an entrance of an inner edge of the receiving hole being provided with an entrance of a diameter slightly greater than a diameter of the receiving hole and an insert ring wall, another end of the receiving hole being provided with an exit of a diameter slightly smaller than the diameter of the receiving hole, the receiving hole being sized to receive the insulation member, one end of the insulation member being sized to be retained in an exit at one end of the receiving hole, with a lateral edge of an enlarged portion of the insulation member abutting against a wall edge of the exit at one end of the interior of the receiving hole, the insert ring member being disposed such that the insert ring member is sized to be insertable into an entrance at one end of the receiving hole, a smaller-diameter portion of the insert ring being inserted into an annular edge at one end of the insulation member surrounded by the entrance of the receiving hole, so that an insert wall provided at the middle portion of the insert ring member abuts against the insert ring wall at an inner edge of the entrance of the receiving hole to thereby retain the insulation member in the receiving hole in the T-shaped connector, whereby the connector has advantages of quick assembly and reduced costs.

* * * * *